US005992652A

United States Patent [19]

Springs

[11] Patent Number: 5,992,652

[45] Date of Patent: Nov. 30, 1999

[54] REFILL INDICATOR FOR PRODUCT DISPLAY AND DISPENSING SYSTEM

[75] Inventor: Keith A. Springs, Germantown, Tenn.

[73] Assignee: Newell Operating Company, Freeport, Ill.

[21] Appl. No.: 08/902,676

[22] Filed: Jul. 30, 1997

[51] Int. Cl.[6] ..... A47F 1/04

[52] U.S. Cl. ..... 211/59.3

[58] Field of Search ..... 211/59.3, 59.2

[56] References Cited

U.S. PATENT DOCUMENTS

| | | | |
|---|---|---|---|
| 2,652,154 | 9/1953 | Stevens | 211/59.3 X |
| 2,738,881 | 3/1956 | Michel | 211/59.3 |
| 3,083,067 | 3/1963 | Vos et al. | 211/59.3 X |
| 3,110,402 | 11/1963 | Mogulescu | 211/59.3 |
| 3,308,961 | 3/1967 | Chesley | 211/59.3 |
| 3,591,049 | 7/1971 | Auriemma . | |
| 3,724,715 | 4/1973 | Auriemma . | |
| 4,303,162 | 12/1981 | Suttles . | |
| 4,386,710 | 6/1983 | Dauman . | |
| 4,742,936 | 5/1988 | Rein . | |
| 4,744,489 | 5/1988 | Binder et al. | 211/128.1 X |
| 4,907,707 | 3/1990 | Crum | 211/59.3 |
| 5,069,349 | 12/1991 | Wear et al. | 211/59.3 |
| 5,110,192 | 5/1992 | Lauterbach | 211/59.3 X |
| 5,240,126 | 8/1993 | Foster et al. | 211/59.3 |
| 5,265,738 | 11/1993 | Yablans et al. | 211/59.3 |
| 5,366,099 | 11/1994 | Schmid | 211/59.3 |
| 5,390,802 | 2/1995 | Pappagallo et al. | 211/59.3 |
| 5,413,229 | 5/1995 | Zuberbuhler et al. | 211/59.3 |
| 5,562,217 | 10/1996 | Salveson et al. | 211/59.3 |
| 5,634,564 | 6/1997 | Spamer et al. | 211/59.3 |
| 5,685,664 | 11/1997 | Parham et al. | 211/59.3 X |

*Primary Examiner*—Daniel P. Stodola
*Assistant Examiner*—Erica B. Harris
*Attorney, Agent, or Firm*—Foley & Lardner

[57] ABSTRACT

A product display and dispensing system includes a tray configured for supporting a series of products between a rear end and a front end of the tray, a forward feed device movably supported between the rear end and the front end for pushing the series of products towards the front end and a visual indicator. The visual indicator is movably supported between a first position in which the indicator is visually obscure and a second position in which the indicator projects above the series of products so as to be visually apparent. The visual indicator moves from the first position to the second position in response to movement of the forward feed device and the series of products past a preselected point between the rear end and the front end of the tray.

18 Claims, 3 Drawing Sheets

FIG. 1
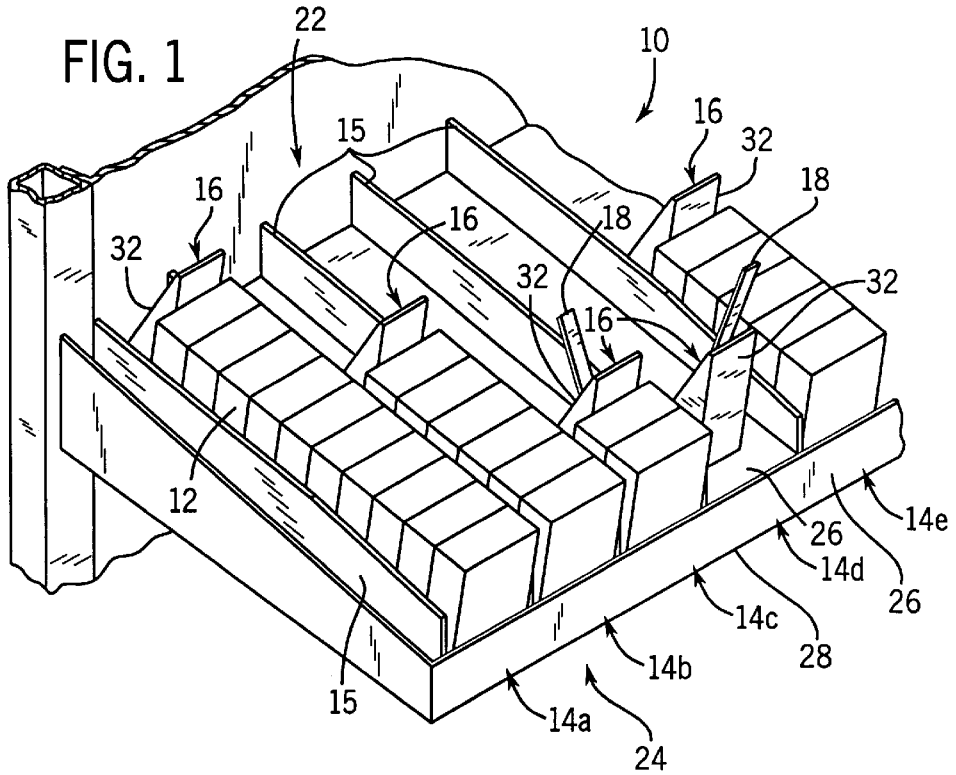
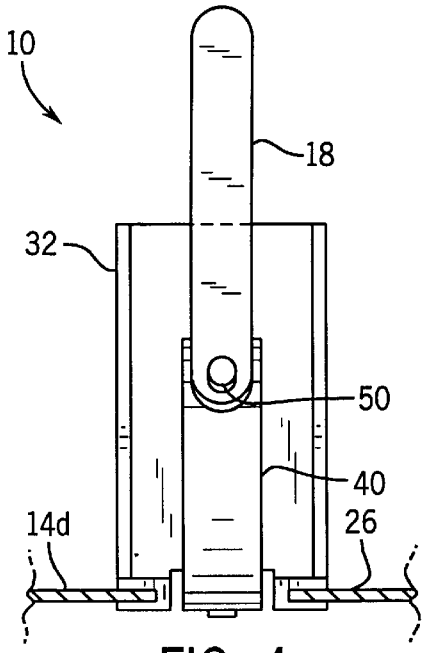
FIG. 4
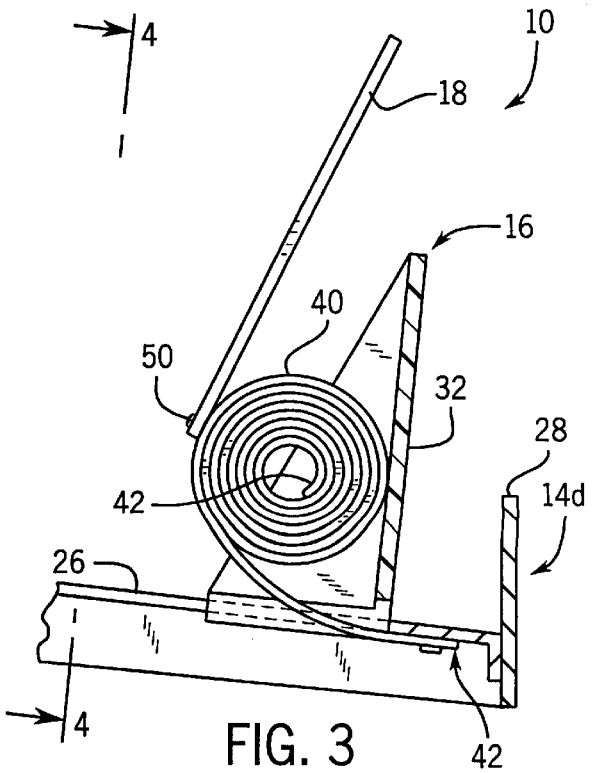
FIG. 3

FIG. 5
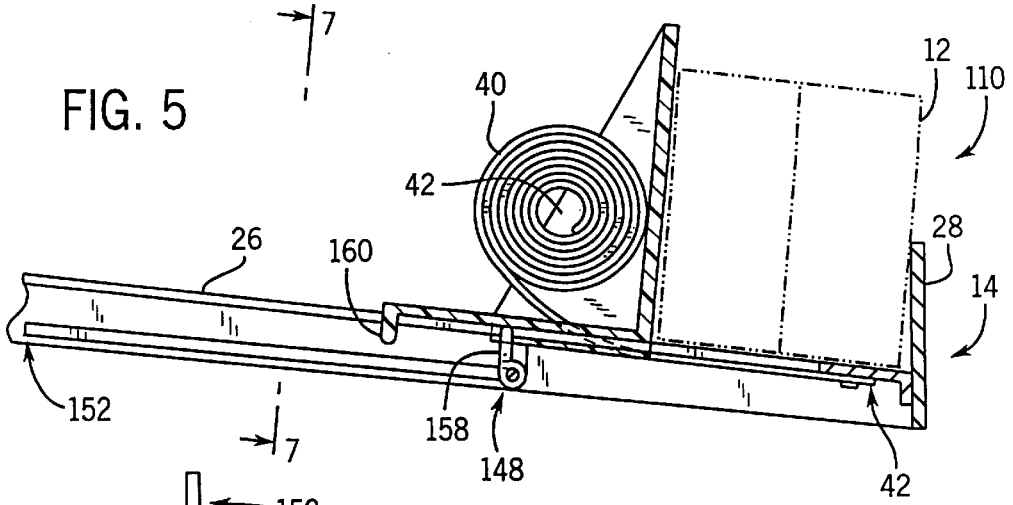
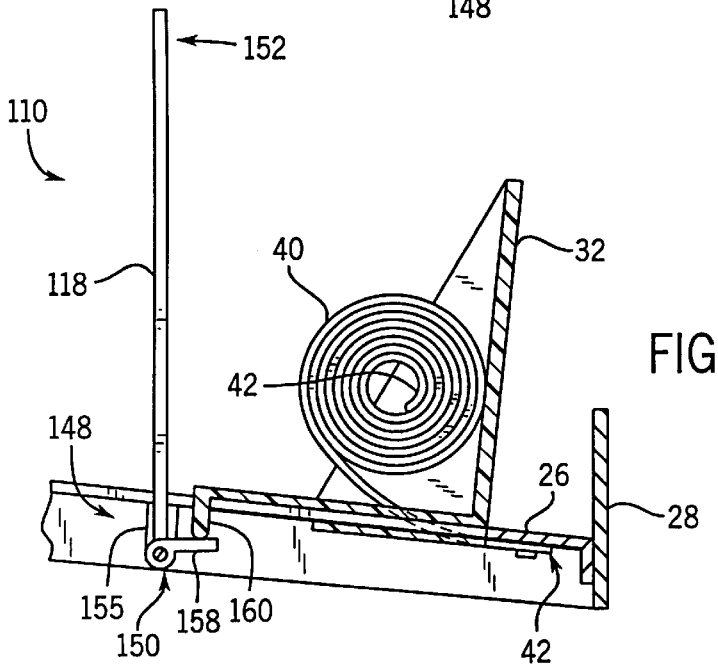
FIG. 6
FIG. 7
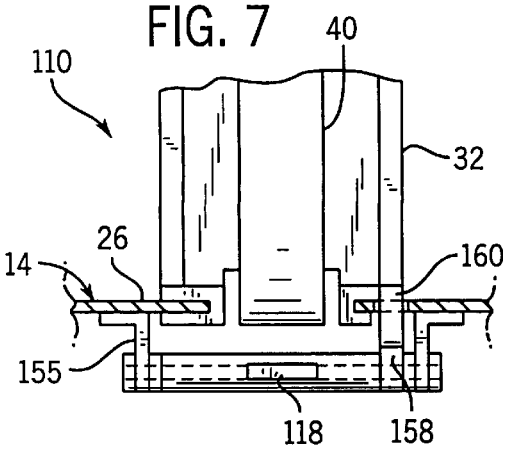
FIG. 8
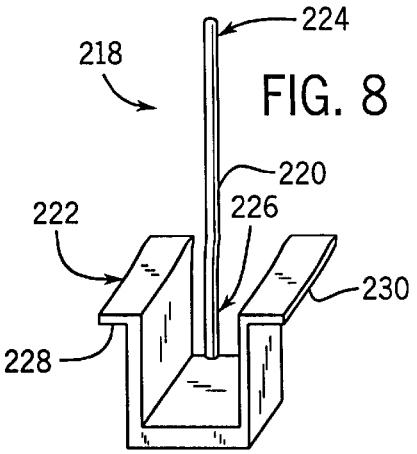

REFILL INDICATOR FOR PRODUCT DISPLAY AND DISPENSING SYSTEM

FIELD OF INVENTION

The present invention relates to systems for displaying and dispensing products and merchandise. In particular, the present invention relates to a refill indicator for use with a product display and dispensing system to visually indicate a depleted quantity of the product within the system.

BACKGROUND OF INVENTION

Product display and dispensing systems, also known as merchandisers, are commonly used in the retail industry for displaying as well as dispensing a series of stacked products. Typical product display and dispensing systems include a tray configured for containing a series of products and a forward feed device for engaging a rearward most product to push the entire series of products toward the front end of the tray. To prevent the forward feed device from pushing the products out of the tray, the tray includes a front wall that engages the frontward most products. As a result, the series of products is automatically forced to the front of the tray in the front of the shelf where the products can be easily seen and removed by customers.

Because product display and dispensing systems are typically supported between relatively closely spaced shelves and because the forward feed device automatically forces the series of products to the front end of the tray and to the front end of the shelf, it is sometimes difficult to determine the inventory level within the display and dispensing system. As a result, ordering stock and reloading the product display and dispensing system in a timely manner to insure fully stocked shelves is also difficult.

In an attempt to facilitate timely stock reordering and reloading of products, several product display and dispensing systems include embossed numerals which appear one-by-one through a viewing window as the products are removed from the system. Because the numerals are constantly presented at the front of the system regardless of the particular inventory level, stockers must visually inspect each and every product display and dispensing system to determine which particular systems require additional stock.

Moreover, because a typical retail shelf may include a multitude of product display and dispensing systems, and because the numerals of each product display and dispensing system are presented at the front of the trays, the multitude of numerals tend to detract the consumer's attention from the promotional displays and the products themselves. The multitude of varying numbers and windows is aesthetically unpleasing. As a result, there is a continuing need for a product display and dispensing system that presents products at the front of a shelf in an orderly and neat fashion while inconspicuously indicating to a product stocker or clerk when the inventory level of the system has been depleted.

SUMMARY OF THE INVENTION

The present invention is directed to a product display and dispensing system including a tray configured for supporting a series of products between a rear end and a front end of the tray, a forward feed device movably supported between the rear end and the front end for pushing the series of products towards the front end and a visual indicator. The visual indicator is movably supported between a first position in which the indicator is visually obscure and a second position in which the indicator projects above the series of products so as to be visually apparent. The visual indicator moves from the first position to the second position in response to movement of the forward feed device and the series of products past a preselected point between the rear end and the front end of the tray.

The present invention is more specifically directed to a product display and dispensing system wherein the forward feed device actuates the visual indicator from the first position to the second position. Preferably, the forward feed device is pivotally supported between the front end and the rear end of the tray such that the forward feed device pivots the visual indicator from the first position to the second position. Preferably, the forward feed device is resiliently biased towards the front end by a coil spring.

In a second preferred embodiment, the forward feed device is resiliently biased towards the front end by a coil spring which carries the visual indicator. As the coil spring recoils, the coil spring moves the visual indicator between the first position and the second position.

In a third preferred embodiment, the visual indicator is pivotally supported below the forward feed device and the series of products in the first position, wherein the forward feed device includes a downwardly extending tripper for engaging the visual indicator to pivot the visual indicator to the second position.

Alternatively, the visual indicator is resiliently supported in the second position. The forward feed device deforms the visual indicator into the first position. The visual indicator resiliently returns to the second position in response to movement of the forward feed device and the series of products past the preselected point.

BRIEF DESCRIPTION OF THE DRAWINGS

FIG. 1 is a fragmentary perspective view of a product display and dispensing system of the present invention including visual indicators.

FIG. 3 is a fragmentary sectional view of the product and display dispensing system illustrating the first embodiment of the visual indicator in a visually apparent position.

FIG. 4 is a sectional view of the product display and dispensing system of FIG. 3 taken along lines 4—4.

FIG. 5 is a sectional view of an alternate embodiment of the product display and dispensing system of FIGS. 1–4 including a second embodiment of a visual indicator in a visually obscure position.

FIG. 6 is a fragmentary sectional view of the product display and dispensing system of FIG. 5 illustrating the second embodiment of the visual indicator in a visually apparent position.

FIG. 7 is a fragmentary sectional view of the product display and dispensing system of FIG. 5 taken along lines 7—7.

FIG. 8 is a perspective view of a third embodiment of a visual indicator.

DETAILED DESCRIPTION OF THE PREFERRED EMBODIMENTS

Figure 2:
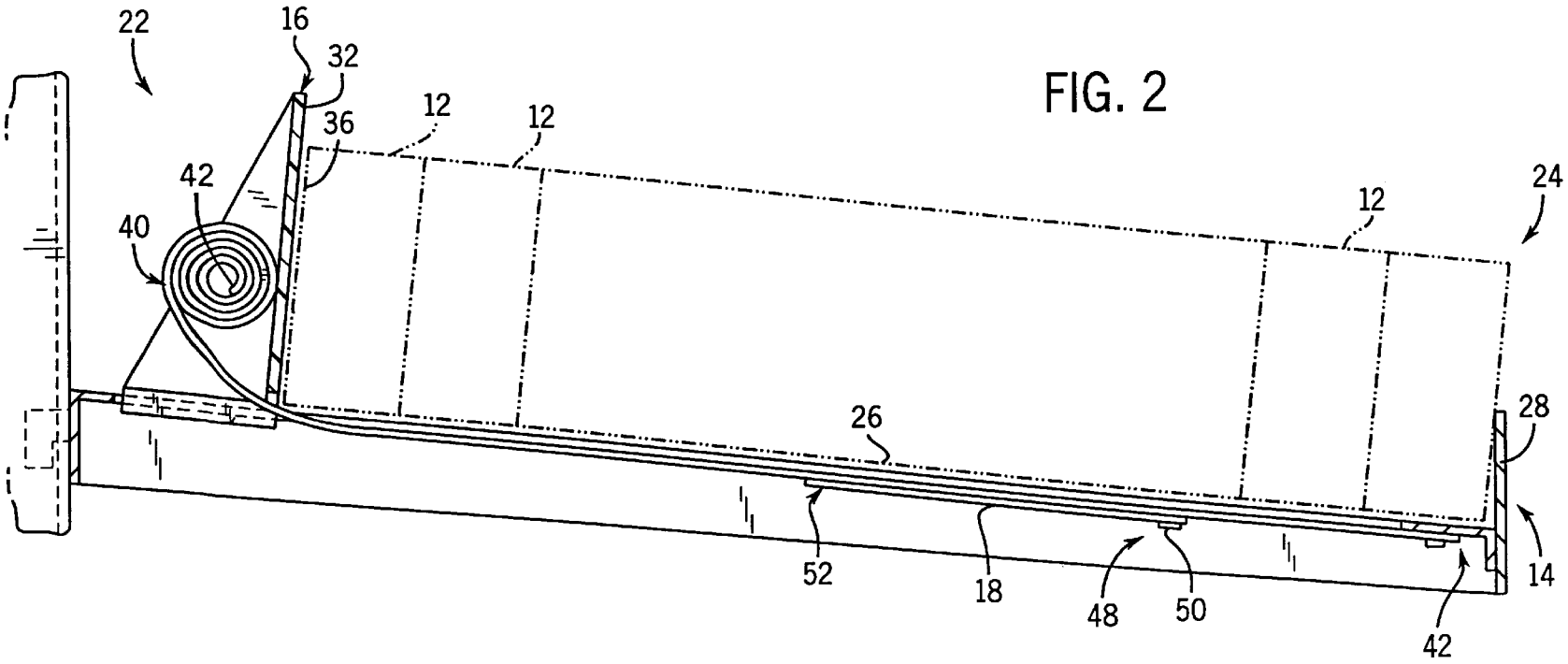
FIG. 2 is a sectional view of the product display and dispensing system including a first embodiment of a visual indicator in a visually obscure position.

FIG. 1 is a fragmentary perspective view of a product display and dispensing system 10 for products 12. Display and dispensing system 10 generally includes trays 14*a*, 14*b*, 14*c*, 14*d* and 14*e*, forward product feed devices 16 and visual indicators 18. Trays 14*a*, 14*b*, 14*c*, 14*d* and 14*e* (collectively referred to as trays 14) are configured for containing products 12 in a stacked relationship between rear end 22 and front end 24 of each tray 14.

Each tray 14 preferably includes a floor 26 and a front wall 28. Floor 26 extends between rear end 22 and front end 24 of each tray and supports products 12 as products 12 are moved forwardly by forward product feed devices 16. Alternatively, floor 26 supports forward product feed devices 16 which carry products 12 toward front end 24 of trays 14. Front wall 28 extends along front end 24 of each tray 14. Front wall 28 provides a generally flat vertical surface at the front end 24 of each tray 14 to maintain product 12 therein.

Trays 14*a*, 14*b*, 14*c*, 14*d* and 14*e* are preferably separated by product flow guides 15. Product flow guides 15 comprise elongate panels extending between rear end 22 and front end 24 of each tray 14. Product flow guides 15 are preferably positioned between adjacent trays 14. Product flow guides 15 provide vertical surfaces which engage sides of products 12 to maintain products 12 in a neat and orderly stacked series as products 12 are moved forwardly towards front wall 28 by forward product feed devices 16.

Forward product feed devices 16 are movably supported between rear end 22 and front end 24 for urging corresponding series of stacked adjacent products 12 toward front end 24 of each corresponding tray 14. Forward product feed devices 16 each preferably include a pusher member 32 for engaging a rearward most product 12 so as to push the entire series of products 12 toward front end 24. Each product feed device 16 is preferably resiliently biased towards front end 24 so as to automatically force the series of products 12 forward toward front end 24 as frontward most products 12 are removed from tray 14.

Visual indicators 18 are each movably supported between a first visually obscure position and a second visually apparent position. Each visual indicator 18 remains in the visually obscure position until the number of products 12 within the corresponding tray dwindles to a preselected number. Once the number of products 12 within an individual tray is less than the preselected number, visual indicator 18 moves to the visually apparent position to indicate to a shelf stocker that stock is low and must be reordered or that the particular tray 14 must be reloaded shortly. As illustrated with respect to trays 14*a*, 14*b* and 14*e*, visual indicators 18 remain in the visually obscure position so long as the number of products 12 within trays 14*a*, 14*b* and 14*e* is greater than a preselected number.

As illustrated with respect to trays 14*c* and 14*d*, once the quantity of products 12 within trays 14*c* and 14*d* number less than the preselected number, visual indicator 18 automatically moves to the visually apparent position. In the visually apparent position, visual indicator 18 projects above the series of products 12 and preferably above pusher member 32 for quick and easy identification by a shelf stocker. Visual indicators 18 preferably move from the first visually obscure position to the second visually apparent position in response to movement of either products 12 or pusher member 32 past a preselected point between rear end 22 and front end 24 of tray 14.

FIG. 2 is a sectional view of product display and dispensing system 10 taken along an axial center line of an individual tray 14*a*. FIG. 2 illustrates forward product feed device 16 and visual indicator 18 in greater detail. As best shown by FIG. 2, pusher member 32 preferably slides along floor 26 of tray 14 between rear end 22 and front end 24. Pusher member 32 preferably slidably engages floor 26 of tray 14*a* for movement between rear end 22 and front end 24. Pusher member 32 engages a rearward most surface 36 of rearward most product 12 to urge the entire series of products 12 towards front wall 28.

As further shown by FIG. 2, forward product feed device 16 preferably includes a coil spring 40 for urging pusher member 32 and the engaged series of products 12 towards front end 24. Coil spring 40 has a first end 42 fixedly secured proximate a front end 24 of tray 14*a*. End 42 is preferably fixedly secured by a rivet or other such fasteners to floor 26 adjacent front wall 28 of tray 14*a*. As shown by FIG. 2, coil spring 40 extends rearwardly from end 42 adjacent to and along floor 26. Coil spring 40 preferably extends through pusher member 32 and rearwardly behind pusher member 32 such that second end 42 is coiled behind pusher member 32. As coil spring 40 recoils, coil spring 40 urges pusher member 32 and products 12 toward front wall 28. Coil spring 40 resiliently biases pusher member 32 towards front end 24 of tray 14.

Visual indicator 18 preferably comprises an elongate band or flag made of a resilient material such as metal.

Visual indicator 18 has a first end 48 fastened to coil spring 40 by a fastener 50 and a second end 52 positioned rearwardly from end 48 towards rear end 22 of tray 14*a*. End 48 is preferably secured to coil spring 40 at a location rearwardly spaced from front wall 28 so as to indicate when pusher member 32 has been urged forwardly by coil spring 40 beyond a preselected point along tray 14*a*. Until coil spring 40 recoils beyond end 48 of visual indicator 18, visual indicator 18 remains in the visually obscure position shown. In the visually obscure position, visual indicator 18 preferably extends parallel and adjacent to coil spring 40 and floor 26 of tray 14*a* below products 12.

FIGS. 3 and 4 illustrate visual indicator 18 extending above pusher member 32 so as to be visually apparent. FIG. 3 is a fragmentary sectional view of product display and dispensing system 10 taken along an axial centerline of individual tray 14*d*. FIG. 4 is a cross sectional view of product display and dispensing system 10 taken along lines 4—4 of FIG. 3. As best shown by FIG. 3, as products 12 are removed from tray 14*b*, coil spring 40 recoils to urge pusher member 32 towards front wall 28. Because visual indicator 18 is attached to coil spring 40, coil spring 40 carries visual indicator 18 while coil spring 40 recoils behind pusher member 32. As a result, coil spring 40 moves visual indicator 18 from the visually obscure position (shown in FIG. 2) to the visually apparent position (shown in FIGS. 3 and 4) . As shown by FIGS. 3 and 4, visual indicator 18 extends generally tangential to coil spring 40 behind pusher member 32 so as to project from coil spring 40 above pusher member 32 to visually indicate when the number of products 12 within an individual tray, such as tray 14*d*, have dwindled to a number such that new stock must be ordered or such that restocking of tray 14*d* is required.

As shown by FIG. 1, visual indicator 18 preferably projects above pusher member 32 so as to be visually apparent when two or less products 12 remain within an individual tray 14*d*. As can be appreciated, the time required for reordering products 12 or restocking trays 14 may vary depending upon a multitude of factors such as product demand and delivery time. Thus, the point at which visual indicator 18 projects above pusher member 32 into the visually apparent position may be simply adjusted by reattaching end 48 of visual indicator 18 to coil spring 40 at various locations along the length of coil spring 40. For example, visual indicator 18 may alternatively be fastened closer to end 42 of coil spring 40 to visually indicate when the number of products 12 within an individual tray 14 dwindles below a greater preselected quantity.

FIGS. 5–7 illustrate product display and dispensing system 110, an alternate embodiment of product display and dispensing system 10 shown in FIGS. 1–4. Product display and dispensing system 110 is similar to product and display and dispensing system 10 except that product display and dispensing system 110 includes visual indicator 118 and actuator 150 in lieu of visual indicator 18. Visual indicator 118 preferably comprises an elongate band or flag having a first end 148 pivotally coupled to tray 14 and a second end 152 opposite end 148 for pivoting above floor 26 and preferably above pusher member 32. Visual indicator 118 is preferably pivotally supported below floor 26 by projection member 155. Projection member 155 extends downwardly from floor 26 and defines a bore for pivotally receiving a corresponding projection of visual indicator 118.

Actuator 150 pivots visual indicator 118 in response to movement of forward feed device 16 and the series of products 12 past a preselected point between rear end 22 and front end 24 of tray 14. Actuator 150 includes trigger 158 and tripper 160. Trigger 158 is fixedly coupled to visual indicator 118 and obliquely extends from visual indicator 118 for being engaged by tripper 160. In the embodiment illustrated, trigger 158 is fixedly coupled directly to visual indicator 118 and extends generally perpendicular to visual indicator 118. In the preferred embodiment illustrated, trigger 158 is plastic and is integrally formed as part of visual indicator 118. Alternatively, trigger 158 may be separately formed and mounted to visual indicator 118 or may be separately formed and indirectly coupled to visual indicator 118. Trigger 158 may have a variety of different shapes and dimensions dependent upon the shape and dimensions of tripper 160.

Tripper 160 projects from pusher member 32 and is configured for engaging trigger 158 to pivot visual indicator 118 from a first obscure position below floor 26 shown in FIG. 5 to a second visually apparent position shown in FIG. 6. In the embodiment illustrated, tripper 160 comprises an elongate protuberance extending downwardly from pusher member 32 behind coil spring 40. Although tripper 160 is illustrated as being integrally formed as part of pusher member 32 and downwardly extending from pusher member 32 behind coil spring 40, tripper 160 may alternatively be individually mounted or otherwise secured in various other locations so as to extend into engagement with trigger 158 upon movement of pusher member 32 by coil spring 40.

As best shown by FIGS. 5 and 6, as products 12 are removed from tray 14, coil spring 40 recoils behind pusher member 32 to force pusher member 32 and the remaining products 12 towards front wall 28. As pusher member 32 moves forwardly, tripper 160 engages trigger 158 to pivot visual indicator 118 from a generally obscure position behind and below pusher member 32 to a visually apparent position above pusher member 32. In the visually apparent position, visual indicator 118 inconspicuously indicates that the inventory level of products 12 within system 10 are depleted such that products 12 must be restocked and reordered. Although visual indicator 118 is illustrated as pivoting to the visually apparent position when only one product 12 remains within tray 14, visual indicator 118 and trigger 158 may alternatively be positioned substantially anywhere along tray 14 between rear end 22 and front end 24 so as to indicate when the quantity of products 12 has been depleted below a desired level.

FIG. 8 is a perspective view of visual indicator 218, an alternate embodiment of visual indicators 18 and 118 shown in FIGS. 1–7. Visual indicator 218 includes flag 220 and mount 222. Flag 220 is a generally elongate band or pole having a first end 224 and a second end 226 extending from mount 222. Flag 220 is preferably formed from a resilient flexible material so as to bend or flex between a first position in which flag 220 extends below products 12 and below coil 40 (shown in FIGS. 1–7) and a second position in which flag 220 extends from tray 14 above products 12 and above pusher member 32 (shown in FIGS. 1–7). In the preferred embodiment illustrated, flag 220 is formed from ENGAGE 8401 sold by Dow Chemical.

Mount 222 is fixedly coupled to end 226 of flag 220 and securely fastens flag 220 to tray 14 below products 12 and below coil spring 40 and pusher member 32. In the preferred embodiments illustrated, mount 222 is specifically configured for being inserted through a correspondingly sized and shaped detent in floor 26 of tray 14 to mount flag 220 to tray 14. As shown by FIG. 8, mount 222 preferably includes two outwardly projecting wings 228, 230 which rest and support mount 222 above tray 14. In the preferred embodiment illustrated, flag 220 is integrally formed as part of mount 222. Alternatively, mount 222 may be securely fastened to flag 220. Moreover, mount 222 may be omitted in favor of other conventional fastening means for mounting flag 220 to tray 14.

Once positioned within tray 14, visual indicator 218 automatically indicates when the quantity of products 12 have been depleted below a preestablished number. In particular, when tray 14 is filled with products 12, coil spring 40 and products 12 extend over and above flag 220 to bend and flex flag 220 towards floor 26 of tray 14 below products 12 and below coil spring 40. As products 12 are removed from tray 14, coil spring 40 recoils behind pusher member 32 to force pusher member 32 and products 12 towards front wall 28. Once the number of products 12 within tray 14 have been depleted to a number such that products 12, pusher member 32 and coil spring 40 have moved past flag 220 towards front wall 28, flag 220 resiliently returns to its original vertical position so as to extend above products 12 and above pusher member 32 to inconspicuously indicate that products 12 must be reordered or restocked.

Although the present invention has been described with reference to preferred embodiments, workers skilled in the art will recognize that changes may be made in form and detail without departing from the spirit and scope of the invention.

I claim:

1. A product display and dispensing system comprising:

a tray configured for supporting a series of products between a rear end and a front end of the tray;

a forward feed device movably supported between the rear end and the front end for pushing the series of products towards the front end; and a visual indicator movably supported between a first position in which the indicator is visually obscure and a second position in which the indicator projects above the series of products so as to be visually apparent, wherein the indicator moves from the first position to the second position in response to movement of the forward feed device and the series of products past a preselected point between the rear end and the front end of the tray, wherein the forward feed device engages the visual indicator to actuate the visual indicator from the first position to the second position.

2. The system of claim 1 wherein the visual indicator resiliently flexes between the first position and the second position.

3. The system of claim 1 wherein the visual indicator extends below the series of products, which are pushed by the forward feed device in the first position.

4. The system of claim 1 wherein the visual indicator comprises a flag.

5. The system of claim 1 wherein the visual indicator is pivotally supported between the front end and the rear end and wherein the forward feed device pivots the visual indicator between the first and second positions.

6. The system of claim 5 wherein the visual indicator is pivotally supported below the tray and the series of products in the first position and wherein the forward feed device includes a downwardly extending tripper for engaging the visual indicator to pivot the visual indicator to the second position.

7. The system of claim 1 wherein the forward feed device is resiliently biased towards the front end.

8. The system of claim 7 wherein the forward feed device is resiliently biased towards the front end by a coil spring.

9. The system of claim 8 wherein the visual indicator is fixedly coupled to the coil spring such that the coil spring moves the visual indicator between the first position and the second position.

10. A product display and dispensing system comprising:

a tray configured for supporting a series of products between a rear end and a front end of the tray;

a forward feed device movably supported between the rear end and the front end and resiliently biased towards the front end for moving the series of products towards the front end; and a visual indicator pivotally supported adjacent the forward feed device for movement between a first position in which the indicator is visually obscure and a second position in which the indicator projects above the series of products so as to be visually apparent, the indicator including a lever for being engaged by the forward feed device as a forward feed device moves towards the front end to pivot the visual indicator from the first position to the second position.

11. The system of claim 10 wherein the forward feed device is resiliently biased towards the front end by a coil spring.

12. The system of claim 10 wherein the visual indicator is fixedly coupled to the coil spring such that the coil spring moves the visual indicator between the first position and the second position.

13. The system of claim 10 wherein the visual indicator extends above the forward feed device in the second position.

14. The system of claim 10 wherein the visual indicator extends below the series of products in the first position.

15. The system of claim 10 wherein the visual indicator comprises a flag.

16. The system of claim 10 wherein the visual indicator is pivotally supported between the front end and the rear end and wherein the forward feed device pivots the visual indicator between the first and second positions.

17. The system of claim 16 wherein the visual indicator is pivotally supported below the tray and the series of products in the first position and wherein the forward feed device includes a downwardly extending tripper for engaging the lever to pivot the visual indicator to the second position.

18. A product display and dispensing system comprising:

a tray configured for supporting a series of products between a rear end and front end of the tray;

a forward feed device movably supported between the rear end and the front end for moving the series of products towards the front end, the forward feed device including a coil spring for resiliently biasing the forward feed device towards the front end; and a visual indicator coupled to the coil spring, wherein the coil spring moves on the visual indicator between a first position in which the indicator is visually obscure and a second position in which the indicator projects above the series of products so as to be visually apparent.

* * * * *